US007979987B2

(12) United States Patent
Strand et al.

(10) Patent No.: US 7,979,987 B2
(45) Date of Patent: Jul. 19, 2011

(54) METHOD OF MANUFACTURING FLUID EJECTION DEVICE WITH DRY-FILM PHOTO-RESIST LAYER

(75) Inventors: Thomas R. Strand, Corvallis, OR (US); Manish Giri, Corvallis, OR (US); Jeremy Donaldson, Corvallis, OR (US); William A. Keese, Philomath, OR (US); Mohammed Shaarawi, Corvallis, OR (US); Randall Orson Willard, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 669 days.

(21) Appl. No.: 11/949,509

(22) Filed: Dec. 3, 2007

(65) Prior Publication Data

US 2008/0085476 A1 Apr. 10, 2008

Related U.S. Application Data

(62) Division of application No. 10/864,220, filed on Jun. 8, 2004, now Pat. No. 7,325,309.

(51) Int. Cl.
*B41J 2/145* (2006.01)

(52) U.S. Cl. ..... 29/890.1; 430/270.1

(58) Field of Classification Search ..... 29/890.1; 347/45–47; 430/270.1

See application file for complete search history.

(56) References Cited

U.S. PATENT DOCUMENTS

| | | | | |
|---|---|---|---|---|
| 3,529,960 | A | | 9/1970 | Hilbert |
| 4,657,631 | A | | 4/1987 | Noguchi |
| 4,695,853 | A | | 9/1987 | Hackleman et al. |
| 5,059,973 | A | | 10/1991 | Watanabe |
| 5,183,534 | A | | 2/1993 | Fjare et al. |
| 5,229,785 | A | | 7/1993 | Leban |
| 5,305,018 | A | | 4/1994 | Schantz et al. |
| 5,478,606 | A | | 12/1995 | Ohkuma et al. |
| 5,659,343 | A | * | 8/1997 | Koizumi et al. ..... 29/890.1 X |
| 5,730,889 | A | | 3/1998 | Miyagawa et al. |
| 5,808,644 | A | | 9/1998 | Imamura et al. |
| 5,980,017 | A | | 11/1999 | Sato |
| 6,036,874 | A | | 3/2000 | Farnaam |
| 6,123,863 | A | | 9/2000 | Shimomura et al. |
| 6,162,589 | A | | 12/2000 | Chen et al. |
| 6,179,413 | B1 | | 1/2001 | Coulman et al. |
| 6,290,331 | B1 | * | 9/2001 | Agarwal et al. ..... 347/45 X |
| 6,390,606 | B1 | | 5/2002 | Terui et al. |
| 6,482,574 | B1 | | 11/2002 | Ramaswami et al. |
| 6,557,968 | B2 | | 5/2003 | Lee et al. |
| 6,582,064 | B2 | | 6/2003 | Cruz-Uribe et al. |
| 2001/0020965 | A1 | | 9/2001 | Fujii et al. |
| 2002/0028406 | A1 | * | 3/2002 | Lee et al. ..... 430/270.1 |
| 2002/0039127 | A1 | | 4/2002 | Shin et al. |
| 2002/0067395 | A1 | | 6/2002 | Horii et al. |
| 2002/0191054 | A1 | | 12/2002 | Liu et al. |
| 2003/0184616 | A1 | | 10/2003 | Yang et al. |
| 2003/0202045 | A1 | | 10/2003 | Torgerson et al. |

FOREIGN PATENT DOCUMENTS

| | | | |
|---|---|---|---|
| EP | 921001 | | 12/1998 |
| EP | 783970 | | 5/2003 |
| EP | 842776 | | 2/2004 |
| JP | 11334069 | A * | 12/1999 |

* cited by examiner

*Primary Examiner* — A. Dexter Tugbang

(57) ABSTRACT

A method of manufacturing a fluid ejection device includes providing a barrier layer and an orifice layer on a substrate, laminating a layer of photo-resist over a substantially planar surface of the orifice layer, forming an orifice in the orifice layer, and forming a counterbore in the layer of photo-resist, with forming a counterbore in the layer of photo-resist including exposing a portion of the substantially planar surface of the orifice layer within the counterbore.

12 Claims, 6 Drawing Sheets

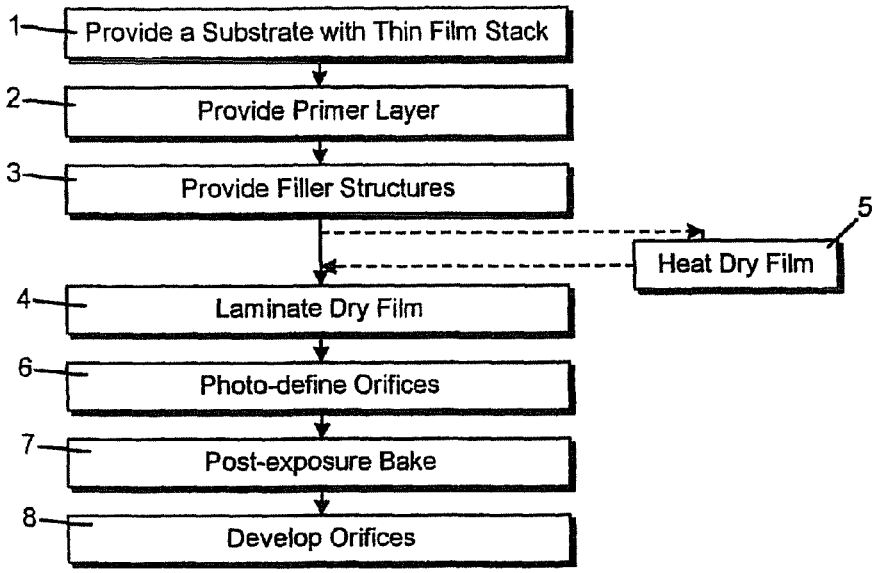
FIG. 1
FIG. 2A
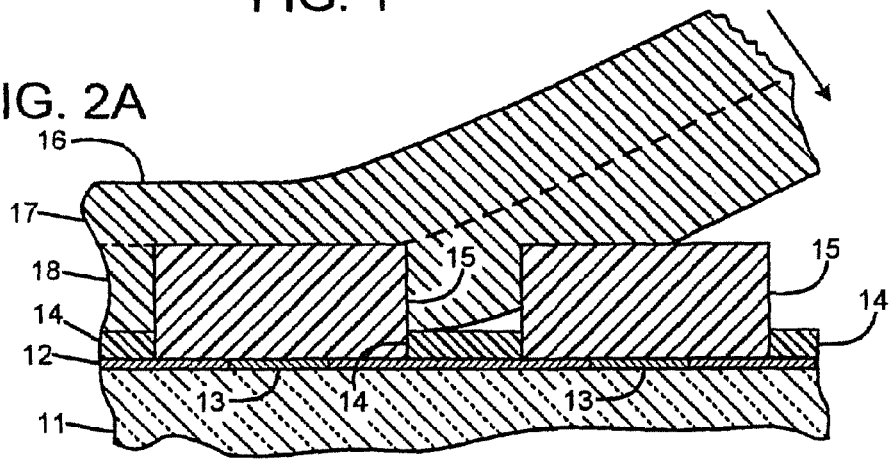
FIG. 2B
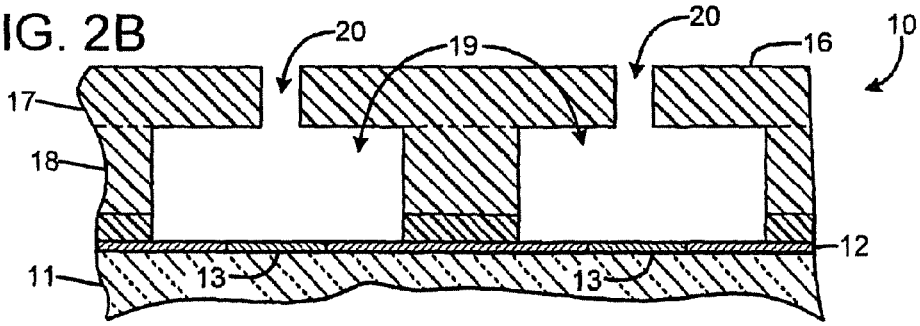

FIG. 4A
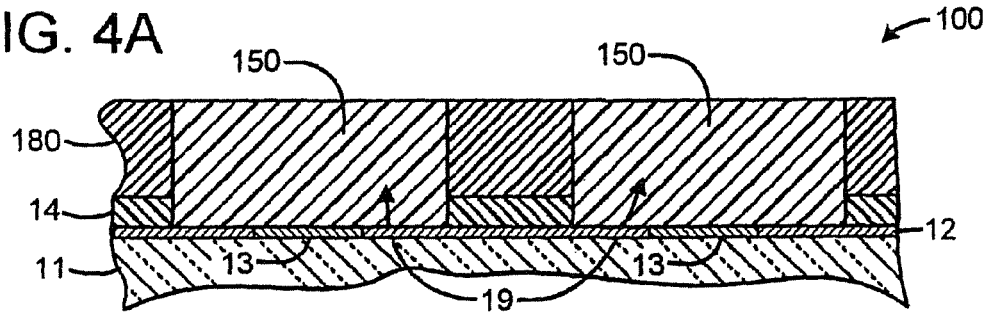
FIG. 4B
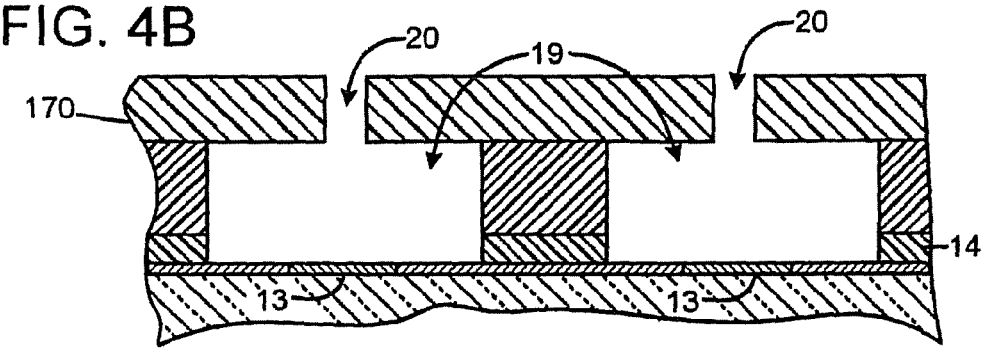
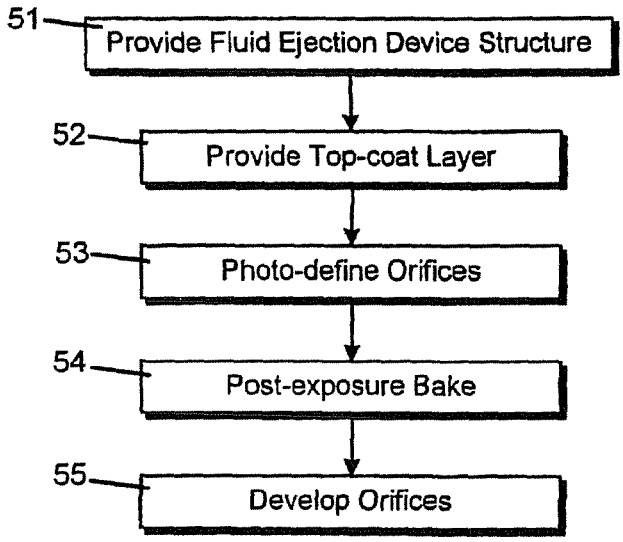
FIG. 5

METHOD OF MANUFACTURING FLUID EJECTION DEVICE WITH DRY-FILM PHOTO-RESIST LAYER

CROSS-REFERENCE TO RELATED APPLICATIONS

This application is a Divisional of copending U.S. patent application Ser. No. 10/864,220, filed on Jun. 8, 2004, now U.S. Pat. No. 7,325,309, which is incorporated herein by reference.

BACKGROUND OF THE DISCLOSURE

Fluid ejection devices, including, for example, inkjet printheads, have an orifice layer with nozzles or orifices through which fluid is ejected. Resistors are provided on a substrate. The resistors are in a firing chamber in a barrier layer below the orifice layer. The resistors are selectively energized, thereby heating fluid in the chamber, causing some of the fluid to be ejected from the nozzle. Changes in the orifice layer and or the barrier layer during manufacturing processes can result in imperfections in the surface of the orifice layer that affect the performance of the fluid ejection device.

Circuitry fabricated on a substrate structure using standard thin film techniques includes a conductive path for carrying electrical power for firing the resistors, an address bus, logic elements, and firing transistors. This circuitry is used to properly energize and operate the resistors. Capacitive coupling between the address bus and the fire line or power bus can generate noise and degrade performance.

BRIEF DESCRIPTION OF THE DRAWINGS

Features and advantages of the invention will be readily appreciated by persons skilled in the art from the following detailed description of exemplary embodiments thereof, as illustrated in the accompanying drawings, in which:

FIG. 1 illustrates an exemplary embodiment of a method of manufacturing a fluid ejection device.

FIGS. 2A and 2B illustrate exemplary embodiments of a fluid ejection device being manufactured in accordance with an exemplary embodiment of the method illustrated in FIG. 1.

FIGS. 4A and 4B illustrate exemplary embodiments of a fluid ejection device being manufactured in accordance with an exemplary embodiment of the method illustrated in FIG. 3.

FIG. 5 illustrates an exemplary embodiment of a method of manufacturing a fluid ejection device.

DETAILED DESCRIPTION OF THE DISCLOSURE

Figure 3:
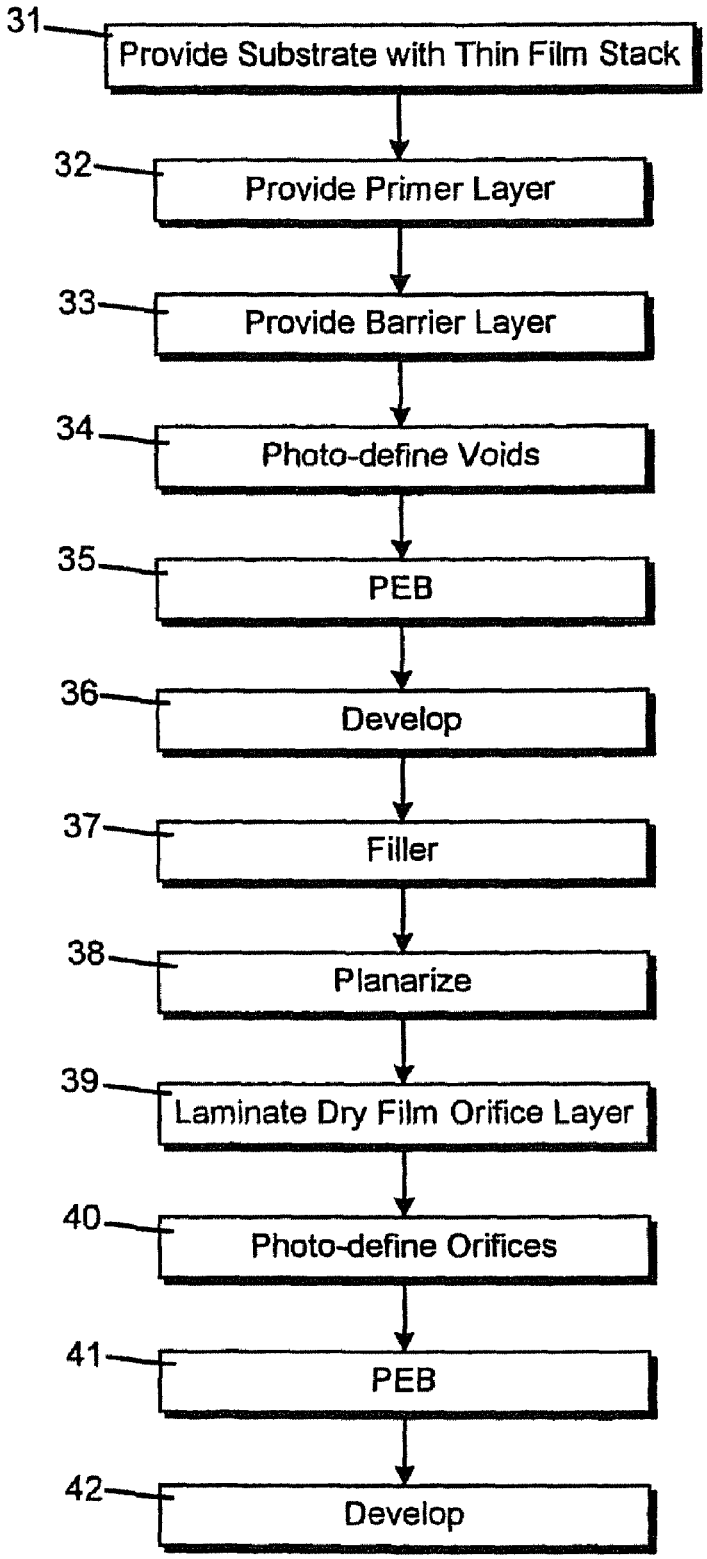
FIG. 3 illustrates an exemplary embodiment of a method of manufacturing a fluid ejection device.

In the following detailed description and in the several figures of the drawing, like elements are identified with like reference numerals.

FIG. 1 illustrates an exemplary embodiment of a process for manufacturing a fluid ejection device with an orifice layer comprising a dry-film photo-resist. An exemplary process includes providing a substrate with a thin film stack 1. In an exemplary embodiment, the thin film stack comprises fluid ejection device circuitry. In an exemplary embodiment, the thin film stack comprises control signal paths, power paths, control logic, firing transistors and firing heaters for a fluid ejection device. In a completed fluid ejection device, control signals cause the circuitry to selectively switch power to resistors in a firing chamber, causing fluid within the chamber to expand, thereby expelling a drop of fluid from an associated orifice in fluid communication with the fluid chamber.

An exemplary embodiment comprises providing a primer layer 2. In an exemplary embodiment, a primer layer is provided over the thin film stack. In an exemplary embodiment, the primer comprises a liquid photo-resistive polymer which is spun onto the substrate over the thin film stack. In an exemplary embodiment, the primer layer comprises a layer of photo-resistive SU-8 (which is available from MicroChem Inc.) with a thickness in a range from about 1 um to about 6 um. In an exemplary embodiment, providing the primer layer comprises exposing the layer of photo-resist to radiation through a mask to define the primer layer. The exposed portions define the structural portions of the primer layer and the unexposed portions define voids to be formed in the primer layer during later development of the layer. In an exemplary embodiment, the voids are formed, for example, over resistors in the thin film stack and over portions of the substrate where an ink feed slot is formed.

In an exemplary embodiment, providing the primer layer 2 comprises baking the exposed photo-resist to cross-link the SU-8 in the primer layer and developing the baked photo-resist to remove the unexposed portions and leaving the structural portions of the primer layer. In an exemplary embodiment, providing a primer layer 2 is optional. In an exemplary embodiment, providing a primer layer 2 improves the adhesion of a barrier layer to the substrate.

An exemplary embodiment of the process comprises providing filler structures 3. In an exemplary embodiment, the filler structures are in the shape of voids to be formed in a barrier layer. In an exemplary embodiment, providing the filler structures 3 comprises spinning a layer of filler material onto the substrate over the thin film stack and over the primer layer when present. In an exemplary embodiment, the filler material comprises a positive photo-resist, for example SPR220 which is available from Shipley. In an exemplary embodiment, the filler material is spun onto the substrate to a thickness of from about 5 um to about 30 um.

In an exemplary embodiment, providing the filler structures 3 comprises photo-defining voids to be formed in a barrier layer. In an exemplary embodiment, photo-defining the voids comprises exposing the layer of filler material to radiation through a mask. The unexposed portions of the filler define the shapes of voids to be formed in the barrier layer of the fluid ejection device. The voids may comprise, for example, fluid chambers, fluid channels or other fluidics. In an exemplary embodiment, the filler is exposed to I-line radiation with a dose in a range from 250 to 2500 mJ/cm$^2$. In an exemplary embodiment, with a 14 um thick layer of SPR 220, the exposure dose may be about 1700 mJ/cm$^2$.

In an exemplary embodiment, the exposed filler layer is subjected to a post-exposure bake from about 5 to about 30 minutes long at a temperature from about 110 deg. C. to about 135 deg. C. In an exemplary embodiment, the post-exposure bake may performed on a single wafer hotplate and last about one minute at 80 deg. C., followed by five minutes at 130 deg. C., followed by ten minutes at 130 deg. C. In an exemplary embodiment, the post-exposure bake reduces solvent content in the filler and eliminates photo-activity of the unexposed photo-resist, which may prevent nitrogen gas bubble evolution from the resist during later exposures for defining orifices in an orifice layer.

In an exemplary embodiment, the filler is developed using, for example, a positive photo-resist aqueous TMAH solution. During the development, the exposed portions of the filler are dissolved and removed, leaving the unexposed portions of the filler in the shape of the voids to be formed in a barrier layer of the fluid ejection device.

An exemplary embodiment of the process comprises laminating a dry film over the filler structures 4. In an exemplary embodiment, the dry film is laminated onto the substrate and over the thin-film stack, primer (when present) and filler structures. In an exemplary embodiment, the dry film comprises negative photo-resist. In an exemplary embodiment, the dry film comprises SU-8 with a thickness of from about 10 um to about 60 um. In an exemplary embodiment, laminating a dry film directly over filler structures may result in cost savings by avoiding at least the costs of planarizing or a chemical/mechanical polishing step used in other processes.

An exemplary embodiment comprises heating the dry film 5. In an exemplary embodiment, the dry film is heated to a temperature high enough so that the dry film conforms to the shape of the void-shaped filler structures. In an exemplary embodiment, the dry film is heated prior to and/or during lamination. In an exemplary embodiment, the dry film is heated to a temperature near or above the glass transition temperature of the dry film.

In an exemplary embodiment, the dry film defines a structure that provides the equivalent of a known barrier layer and a known orifice layer. In an exemplary embodiment, the orifice layer may be defined as that portion of the dry film above the height of the filler structures and the barrier layer may be defined as that portion of the dry film that surrounds the filler structures. After later developing of the filler, the filler will be removed, thereby leaving voids such as fluid chambers and fluid channels within the structure.

An exemplary embodiment of the process of FIG. 1 comprises photo-defining orifices 6. In an exemplary embodiment, photo-defining orifices 6 comprises exposing the orifice layer to radiation through a mask. In an exemplary embodiment, the unexposed portions of the orifice layer define the shape of orifices to be formed when the unexposed portions are removed in a later development. In an exemplary embodiment, the exposed portions of the orifice layer comprise the structural portions of the orifice layer that remain in the orifice layer after development. In an exemplary embodiment, the orifice layer is exposed to I-line radiation with a dose in a range from about 250 to about 2500 $mJ/cm^2$. In an exemplary embodiment, the exposure dose is about 750 $mJ/cm^2$.

An exemplary embodiment of the process of FIG. 1 comprises a post-exposure bake 7 after photo-defining the orifices 6. In an exemplary embodiment, where the orifice layer is fabricated of SU8, the post-exposure bake 7 comprises baking the orifice layer at a temperature in a range of about 90 deg. C. to about 125 deg. C. for from about 2 to about 15 minutes. In an exemplary embodiment, the post-exposure bake is performed on a single wafer hotplate and lasts about one minute at about 65 deg. C., followed by four minutes at about 90 deg. C.

An exemplary embodiment of the process of FIG. 1 comprises developing the orifices 8. In an exemplary embodiment, developing the orifices 8 comprises developing the orifice layer using a solvent to remove the unexposed portions of the orifice layer, thereby forming orifices in the orifice layer. In an exemplary embodiment, the solvent comprises ethyl lactate. In an exemplary embodiment, the filler structures are removed by the solvent when the orifices are developed. In an exemplary embodiment, the filler structures are dissolved in the solvent or otherwise and removed through the orifices and/or through a fluid feed slot in the substrate. In an exemplary embodiment, the voids left in the barrier layer comprise fluid chambers and/or fluid channels.

In other exemplary embodiments, the filler structures are removed using different chemistries, for example wet etch or plasma chemistries. In exemplary embodiments, the solvent, wet etch or plasma chemistry used to remove the filler material may depend on the particular filler material used. In an exemplary embodiment, the filler material may comprise spun-on glass and the etchant may comprise any wet HF or isotropic fluorine plasma. In an exemplary embodiment, the filler material may comprise polysilicon and the etchant may comprise TMAH, bromine gas or XeF2. In an exemplary embodiment, the filler material may comprise a photoresist, PMMA or other unreacted polymer and the solvent may comprise a ketone or an ether. In an exemplary embodiment, the filler material may comprise acid-functionalized polyimide (PiRL), PMGI, PMGI/novolac resin mixtures and the etchant may comprise TMAH or other wet etch chemistry.

FIG. 2A illustrates the lamination of a dry film 16 over void-shaped filler structures 15. A substrate 11 has a thin film stack 12 comprising resistors 13. A primer layer 14 has been provided over the substrate 11 and the thin film stack 12. A layer of filler material has been provided, for example spun on, photo-defined and developed, leaving filler structures 15 in the shape of fluid chambers. A dry film 16 is shown being laminated over the filler. In an exemplary embodiment, the dry film is laminated over the filler structures 15 by pressing the dry film down over the filler structures. In an exemplary embodiment, the dry film 16 is heated to a temperature sufficient so that the dry film conforms to the shape of the filler. In an exemplary embodiment, the dry film 16 comprises an epoxy which adheres to the underlying substrate 11 and/or thin film stack 12. The dry film 16 defines a structure which includes barrier layer 18 and an orifice layer 17.

It should be noted that while portions of dry film 16 are described as being a barrier layer 18 and an orifice layer 17, such description is provided for illustrative purposes. Dry film 16 provides a single structure that provides a barrier portions where fluidic passages and chambers may be defined and orifices. The actual height and volume of the fluidic passages and chambers and the volume and shape of the orifices can be independent of the filler material 15 and may be limited by the height, volume, and shape of the dry film 16.

FIG. 2B illustrates the fluid ejection device of FIG. 2A after the lamination has been completed and after orifices 20 in the orifice layer 17 have been photo-defined 6, baked 7, and developed 8 (FIG. 1). The filler structures 15 (FIG. 2A) have been removed by a solvent or using wet etch or plasma chemistries, thereby leaving fluid chambers 19 within the barrier layer 18. The fluid chambers 19 encompass the heater resistors 13. Orifices 20 through the orifice layer 17 are in fluid communication with the fluid chambers 19. When the resistors 13 are selectively energized, fluid within the fluid chambers 19 expands and a droplet of fluid is ejected from the chamber 19 through the orifice 20.

FIG. 3 illustrates an exemplary embodiment of a process for manufacturing a fluid ejection device. An exemplary embodiment comprises providing a substrate with a thin film stack 31 comprising fluid ejection device circuitry. In an exemplary embodiment, a primer layer may be provided 32 over the thin film stack.

An exemplary embodiment of the process of FIG. 3 comprises providing a barrier layer 33. In an exemplary embodiment, providing a barrier layer 33 comprises spinning a barrier layer onto the substrate, over the thin film stack and over the primer layer where present. In exemplary embodiment, the barrier layer comprises a negative photo-resist, such as SU-8. In an exemplary embodiment, the barrier layer has a thickness in a range from about 5 um to about 35 um.

An exemplary embodiment comprises photo-defining voids 34 in the barrier layer. In an exemplary embodiment, photo-defining voids 34 comprises exposing the barrier layer to I-line radiation with a dose in a range from about 250 to about 2500 mJ/cm$^2$. In an exemplary embodiment, the exposure dose is about 500 mJ/cm$^2$. In an exemplary embodiment, the barrier layer is exposed through a mask to define the voids. In an exemplary embodiment, the unexposed portions of the barrier layer define those portions of the barrier layer that are to be removed to form voids. In an exemplary embodiment, the exposed portions of the barrier layer define the structural portions of the barrier layer that are to remain around the voids after the exposed portions have been removed.

An exemplary embodiment comprises a post-exposure bake 35 after photo-defining the voids 34. In an exemplary embodiment, for example where the barrier layer is fabricated of SU8, the barrier layer is subjected to a post-exposure bake for from about 2 to 15 minutes at a temperature in a range from about 90 deg. C. to about 125 deg. C. In an exemplary embodiment, the post-exposure bake is performed on a single wafer hotplate and lasts for about one minute at 65 deg. C., followed by four minutes at about 90 deg. C., followed by about four minutes at about 105 deg. C.

An exemplary embodiment comprises developing the barrier layer 36. In an exemplary embodiment, the barrier layer is developed 36 with a solvent to remove the unexposed portions of the barrier layer thereby forming voids in the barrier layer. In an exemplary embodiment, the solvent comprises ethyl lactate.

An exemplary embodiment comprises filling the voids 37. In an exemplary embodiment, filling the voids 37 comprises filling the voids with a filler material. In an exemplary embodiment, the filler material comprises a novolac resin or a photoresist comprising novolac resin, for example, SPR220. In an exemplary embodiment, the filler material is provided in an amount to fill the voids and to extend above the barrier layer and cover, at least in part, the top surface of the barrier layer.

An exemplary embodiment comprises planarizing 38. In an exemplary embodiment, planarizing 38 comprises removing the filler material that extends above the top of the barrier layer. In an exemplary embodiment, planarizing 38 comprises a chemical/mechanical polishing process for example, to remove excess filler from the surface of the barrier layer and/or to provide a surface suitable for laminating an orifice layer.

An alternate exemplary embodiment does not comprise filling the voids 37. In this alternate, exemplary embodiment, laminating an orifice layer 39 is performed with no filler in the voids. Laminating the orifice layer 39 over the barrier layer may avoid the costs associated with planarizing the filler and barrier layer using a chemical/mechanical polish.

An exemplary embodiment comprises laminating an orifice layer 39 over the barrier layer. In an exemplary embodiment, the orifice layer comprises a dry film. In an exemplary embodiment, the orifice layer comprises a negative photoresist. In an exemplary embodiment, the orifice layer comprises SU-8. In an exemplary embodiment, the orifice layer has a thickness in a range from about 5 um to about 40 um. In an exemplary embodiment, the orifice layer is laminated to the barrier layer by heating and pressing the orifice layer onto the barrier layer. In an exemplary embodiment, the orifice layer and barrier layer comprise film materials which melt, glue or otherwise fuse together.

Forming the orifice layer by laminating a dry film over a barrier layer 39 may avoid problems associated with the intermixing of filler material and orifice layer material that might occur in other manufacturing processes in which the orifice layer is formed by spinning liquid photo-resist over the filler material. For example, laminating a dry film orifice layer 39 over a barrier layer may reduce variability in the thickness of the orifice layer, the barrier layer and the height of the fluid chambers and fluid channels, may reduce the variability in the surface of the orifice layer at the orifice exits, and may reduce the formation of inter-layer defects between the orifice layer and the barrier layer, including the formation of unintended gaps between the barrier layer and orifice layers near walls and peninsulas. Forming the barrier layer and orifice layer by laminating a dry film 39 over a barrier layer may improve drop trajectory and reduce refill variability.

An exemplary embodiment comprises photo-defining orifices 40. In an exemplary embodiment, photo-defining orifices 40 comprises exposing the orifice layer to radiation through a mask to I-line radiation with a dose in a range from about 250 to about 2500 mJ/cm$^2$. In an exemplary embodiment, the exposure dose is about 750 mJ/cm$^2$. In an exemplary embodiment, the exposed portions of the orifice layer define structural portions of the orifice layer and unexposed portions of the orifice layer define orifices to be formed. In an exemplary embodiment, the orifices are formed over fluid chambers in the barrier layer. In an alternate exemplary embodiment, the orifices are formed over those portions of filler in the voids in which fluid chamber are to be formed upon the removal of filler.

An exemplary embodiment comprises a post-exposure bake 41 after photo-defining the orifices 40. In an exemplary embodiment, the orifice layer is baked to cross-link the structural portions of the orifice layer. In an exemplary embodiment, for example with an orifice layer fabricated of SU8, the orifice layer is baked for from about 2 to 15 minutes at a temperature in a range from about 90 to 125 deg. C. In an exemplary embodiment, the post-exposure bake is performed in a single wafer hotplate and lasts for about one minute at 65 deg. C., followed by four minutes at about 90 deg. C.

An exemplary embodiment comprises developing the orifices 42. In an exemplary embodiment, the orifice layer is developed with a solvent. In an exemplary embodiment, the solvent is ethyl lactate. In an exemplary embodiment, the solvent removes unexposed portions of the orifice layer to form the orifices in the orifice layer. In an exemplary embodiment, filler material within the voids in the barrier layer is removed by the solvent when the orifices are developed or by using wet etch or plasma chemistries.

FIG. 4A illustrates an exemplary embodiment of a fluid ejection device 100 during an exemplary embodiment of the process illustrated in FIG. 3. A substrate 11 with a thin film stack 12 comprising resistors 13 is provided. A primer layer 14 has been formed over the thin film stack 12. A barrier layer 180 has been spun onto the substrate 11, over the thin film stack 12 and primer layer 14. The barrier layer 180 has been exposed to radiation to define fluid chambers 19, and has been baked and developed to form the fluid chambers 19. The fluid chambers 19 have been filled with filler material 150 and the barrier layer and any excess filler material 150 have been planarized to remove excess filler material 150 extending above the barrier layer 180 and to provide a suitable surface for laminating an orifice layer 170 (FIG. 4B).

FIG. 4B illustrates an exemplary embodiment of a fluid ejection device with an orifice layer 170. In an exemplary embodiment, the orifice layer comprises a dry film, for example a dry film negative photo-resist such as SU-8. The orifice layer 170 has been laminated onto the planarized surface of the barrier layer 180 and filler material 150. The orifice layer 170 has been exposed to define orifices, baked, and developed. The filler material and unexposed portions of the orifice layer have been removed to form fluid chambers 19 and orifices 20.

FIG. 5 illustrates an exemplary embodiment of a process for manufacturing fluid ejection devices with a laminated top-coat over an orifice layer. An exemplary embodiment comprises providing a fluid ejection device structure 51. In an exemplary embodiment, the fluid ejection device structure comprises a substrate, a thin film stack, a barrier layer and an orifice layer. In an exemplary embodiment, the orifice layer comprises a negative photo-resist which has not yet been exposed to define orifices.

In an exemplary embodiment, the fluid ejection device structure can be provided by an exemplary embodiment of the process illustrated in FIG. 1, but not including photo-defining orifices 6, a post-exposure bake 7 or developing the orifices 8. In an exemplary embodiment, the fluid ejection device structure can be provided by an exemplary embodiment of the process illustrated in FIG. 3, but not including photo-defining orifices 40, a post-exposure bake 41 or developing the orifices 42.

An exemplary embodiment comprises providing a top-coat layer 52 over the orifice layer. In an exemplary embodiment, providing a top-coat layer 52 comprises laminating a top-coat layer over the orifice layer. In an exemplary embodiment, the top-coat layer comprises a dry film photo-resist. In an exemplary embodiment, the top-coat layer comprises, for example, at least one of SU-8, fluoro-epoxide or other fluorinated oligomer. In an exemplary embodiment, the top-coat layer has a thickness of about 2 um.

An exemplary embodiment comprises photo-defining orifices 53. In an exemplary embodiment, photo-defining orifices 53 comprises exposing the top-coat layer to radiation through a mask. In an exemplary embodiment, the top-coat layer is exposed to mercury I-line radiation with a dose in a range from about 250 to about 2500 mJ/cm$^2$. In an exemplary embodiment, the radiation penetrates the top-coat layer and into the orifice layer to define orifices through the top-coat layer and the orifice layer. In an exemplary embodiment, unexposed portions of the top-coat layer and the orifice layer define orifices to be formed when the unexposed portions are later removed during development. In an exemplary embodiment, the orifices are defined over fluid chambers in the barrier layer or over filler located where a fluid chamber is to be formed when the filler is removed.

An exemplary embodiment comprises a post-exposure bake 54. In an exemplary embodiment, the orifice layer and top-coat layer are baked in a two-step post-exposure bake at a temperature of 65 deg. C. for one minute and 90 deg. C. for four minutes. In an exemplary embodiment, the orifice layer and top-coat layer are baked for from two to fifteen minutes at a temperature in a range from about 90 to 125 deg. C.

An exemplary embodiment comprises developing the orifices 55. In an exemplary embodiment, the top-coat layer and orifice layer are developed with a solvent. In an exemplary embodiment, the solvent comprises ethyl lactate. In an exemplary embodiment, filler located in voids in the barrier layer is removed by the solvent.

Figure 6:
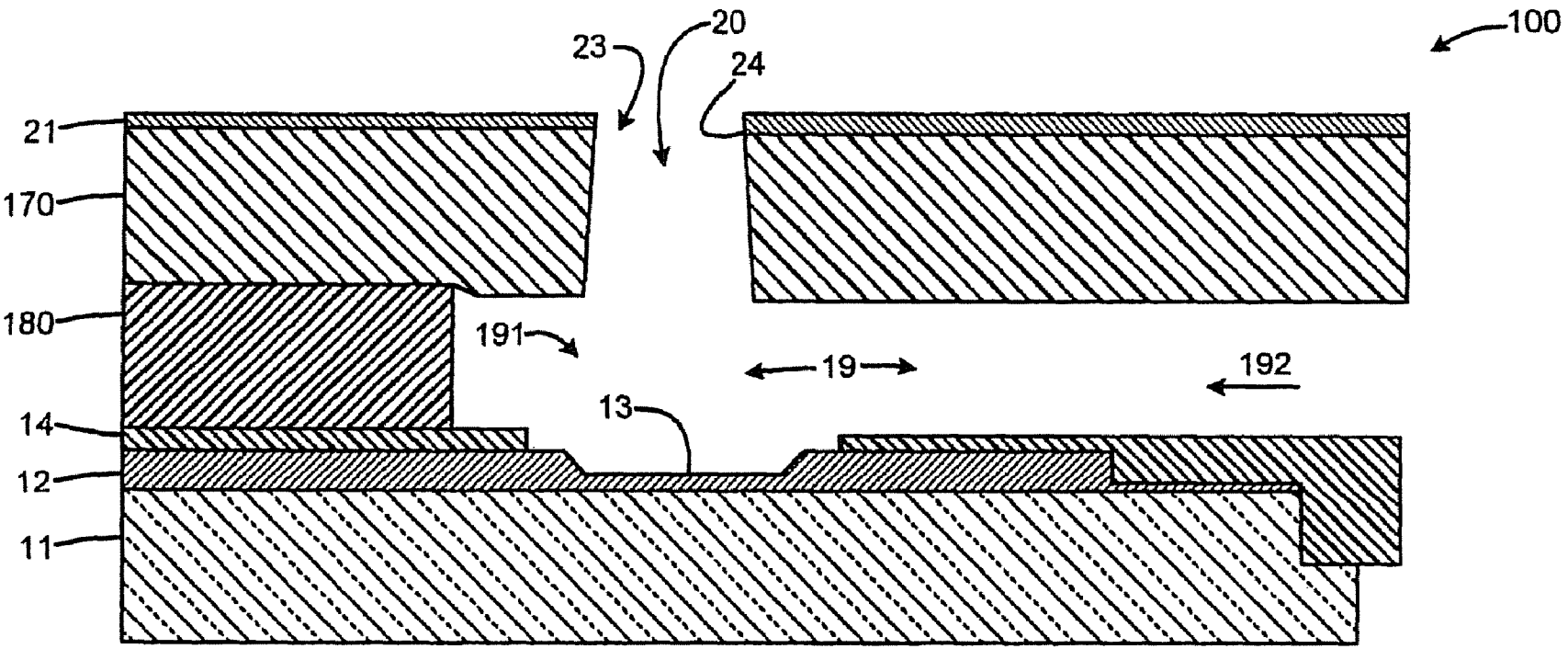
FIG. 6 illustrates an exemplary embodiment of a fluid ejection device manufactured in accordance with an exemplary embodiment of the method illustrated in FIG. 5.

FIG. 6 illustrates a fluid ejection device 100 formed by an exemplary embodiment of the process illustrated in FIG. 5. A thin film stack 12 comprising resistors 13 is formed on a substrate 11. A primer layer 14 has been provided over the thin film stack 12 and the substrate 11. A barrier layer 180 is provided over the primer layer 14. The barrier layer 180 has voids 19 including a fluid chamber 191 and fluid channel 192. An orifice layer 170 is provided over the barrier layer 180. In an exemplary embodiment, the primer layer 14 extends beyond the interior edge of the barrier layer 180, which may improve the adhesion of the barrier layer 180 to the substrate. In exemplary embodiments, the primer layer 14 may extend further into the fluid chambers 19, 191 and/or voids 19 than the interior edges of exemplary barrier layers 18 (FIGS. 2A, 2B) or 180 (FIGS. 4A, 4B) in exemplary embodiments fabricated according to the methods of FIGS. 1 and/or 3.

FIG. 6 illustrates the barrier layer 180 and the orifice layer 170 as two separate layers. However, it should be understood that in an exemplary embodiment, the barrier layer 170 and the orifice layer 180 could be formed by laminating one layer of dry film 16 (FIGS. 2A and 2B) in an exemplary embodiment of the process illustrated in FIG. 1. An orifice 20 has been formed in the orifice layer 170 over the fluid chamber. The orifice 20 extends from the fluid chamber 191 through the orifice layer 170 and the through a top-coat layer 21.

In an exemplary embodiment, there is a surface energy discontinuity 23 in the orifice at the interface 24 between the orifice layer 17 and the top-coat layer 21. In an exemplary embodiment, the orifice layer 17 and the top-coat layer have different surface energies. In an exemplary embodiment, the top-coat layer 21 comprises fluoro-epoxide or other fluorinated oligomer. In an exemplary embodiment, the top-coat layer 21 is more non-wetting, with respect to the fluid to be ejected through the orifices, than is the orifice layer 17 or is at least less wetting than is the orifice layer 17, with respect to the fluid to be ejected through the orifices 20. For example, where the fluid comprises water, the top-coat layer 21 may by hydrophobic. In an exemplary embodiment, the top-coat layer 21 has a low surface energy and/or a lower surface energy than the orifice layer 17. In an exemplary embodiment, fluid can wet the orifice up to the top-coat layer. Due to the surface energy discontinuity 23 or the difference in the wetting properties of the top-coat layer and the orifice layer, the meniscus can be held at the top-coat layer/orifice layer interface 24. In an exemplary embodiment, controlling the location of the meniscus within the orifice 20 may provide puddling control and may improve the performance of the fluid ejection device 100.

Figure 7:
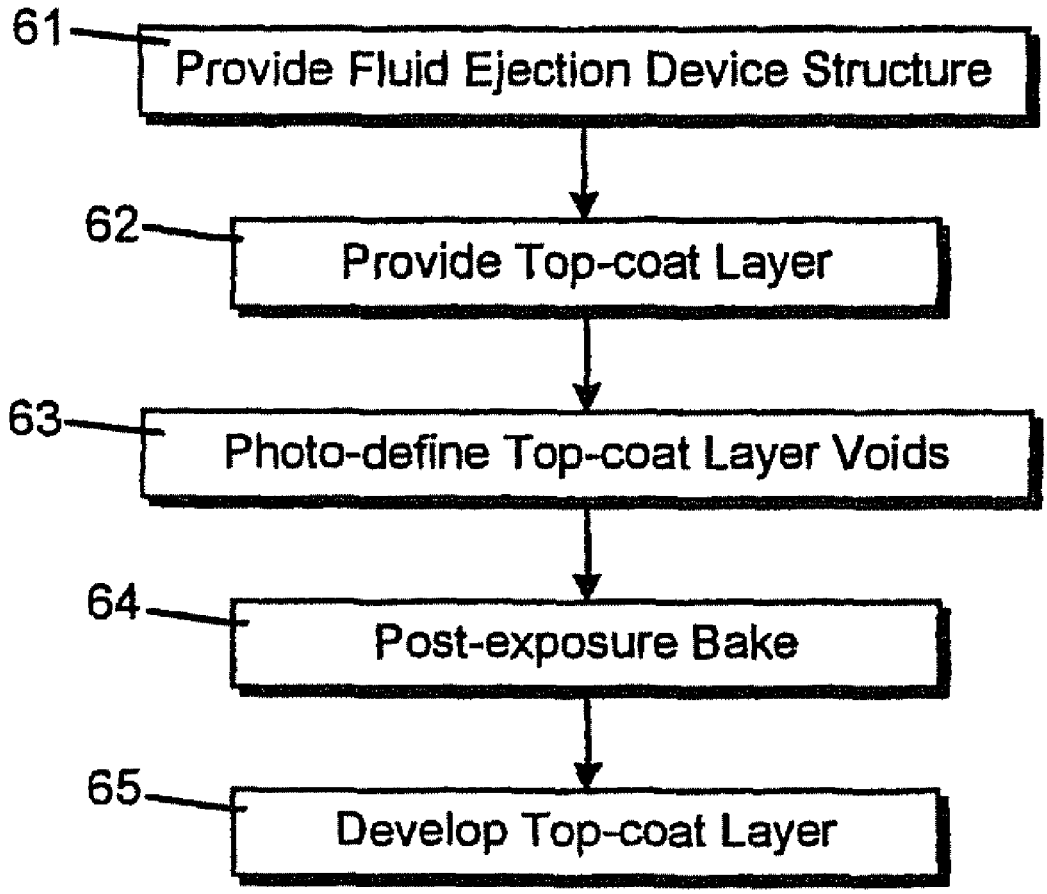
FIG. 7 illustrates an exemplary embodiment of a method of manufacturing a fluid ejection device.

FIG. 7 illustrates an exemplary process for manufacturing a fluid ejection device with a top-coat layer laminated over an orifice layer to form counterbores for orifices through the orifice layer. An exemplary embodiment comprises providing a fluid ejection device structure 61. In an exemplary embodiment, the fluid ejection device structure comprises a substrate, a thin film stack comprising fluid ejection circuitry, a barrier layer and an orifice layer. In an exemplary embodiment, providing the fluid ejection structure 61 can be performed by an exemplary embodiment of the process illustrated in FIG. 1. In an exemplary embodiment, the fluid ejection structure is provided by an embodiment of the process illustrated in FIG. 1, but without developing the orifices 8. In an exemplary embodiment, the fluid ejection device structure is provided by an exemplary embodiment of the process illustrated in FIG. 3. In an exemplary embodiment, the fluid ejection device structure is provided by a manufacturing process illustrated in FIG. 3, but without developing the orifices 42.

An exemplary embodiment comprises providing a top-coat layer 62. In an exemplary embodiment, the top-coat layer is laminated over the orifice layer of the fluid ejection device structure. In exemplary embodiment, the top-coat layer comprises a dry film. In an exemplary embodiment, the top-coat layer comprises a negative photo-resist. In an exemplary embodiment, the top-coat comprises, for example, at least one of SU-8, fluoro-epoxide or other fluorinated oligimer. In an exemplary embodiment, the top-coat layer has a thickness of about 2 um. In an exemplary embodiment, the top-coat layer is laminated onto the orifice layer after the orifice layer has been exposed and baked, but before it is developed. In an alternate, exemplary embodiment, the top-coat layer is laminated over the orifice layer after the orifice layer has been developed.

An exemplary embodiment comprises photo-defining voids in the top-coat layer 63. In an exemplary embodiment, photo-defining voids in the top-coat layer 63 comprises exposing the top-coat layer to radiation through a mask to define voids to be formed in the top-coat layer. In an exemplary embodiment, the exposure dose may be about 500 $mJ/cm^2$. In an exemplary embodiment, the voids to be formed in the top-coat layer comprise at least one of counterbores around orifices, fluid channels, troughs, moats or other recesses near and/or encircling one or more of the orifices. In an exemplary embodiment, a void, for example a counterbore, to be formed around an orifice is larger than the orifice and completely encompasses the orifice. In an exemplary embodiment, a counterbore could be formed to be the same size as the orifice. However, where it is desired to have the top-coat layer and the orifice layer the same size, it may be desirable to form an orifice through both the top-coat layer and the orifice layer using an exemplary embodiment of the process illustrated in FIG. 5.

An exemplary embodiment comprises a post-exposure bake 64. In an exemplary embodiment, the post-exposure bake 64 comprises a two-step post-exposure bake at a temperature of 65 deg. C. for one minute and 90 deg. C. for 4 minutes. In an exemplary embodiment, the orifice layer and top-coat layer are baked for 2 to fifteen minutes at a temperature in a range from about 90 to 125 deg. C.

An exemplary embodiment comprises developing the top-coat layer 65. In an exemplary embodiment, the top-coat layer is developed using a solvent. In exemplary embodiment, the orifice layer may be developed by the solvent. In an exemplary embodiment, any filler remaining within the barrier layer may be removed by the solvent. In an exemplary embodiment, developing the top-coat layer 65 comprises forming counterbores around orifices in the orifice layer. In an exemplary embodiment, the orifices in the orifice layer are developed by the solvent when the top-coat layer is developed. In an exemplary embodiment, filler structures or filler material in voids in the barrier layer are removed by the solvent when the top-coat layer is developed.

Figure 8:
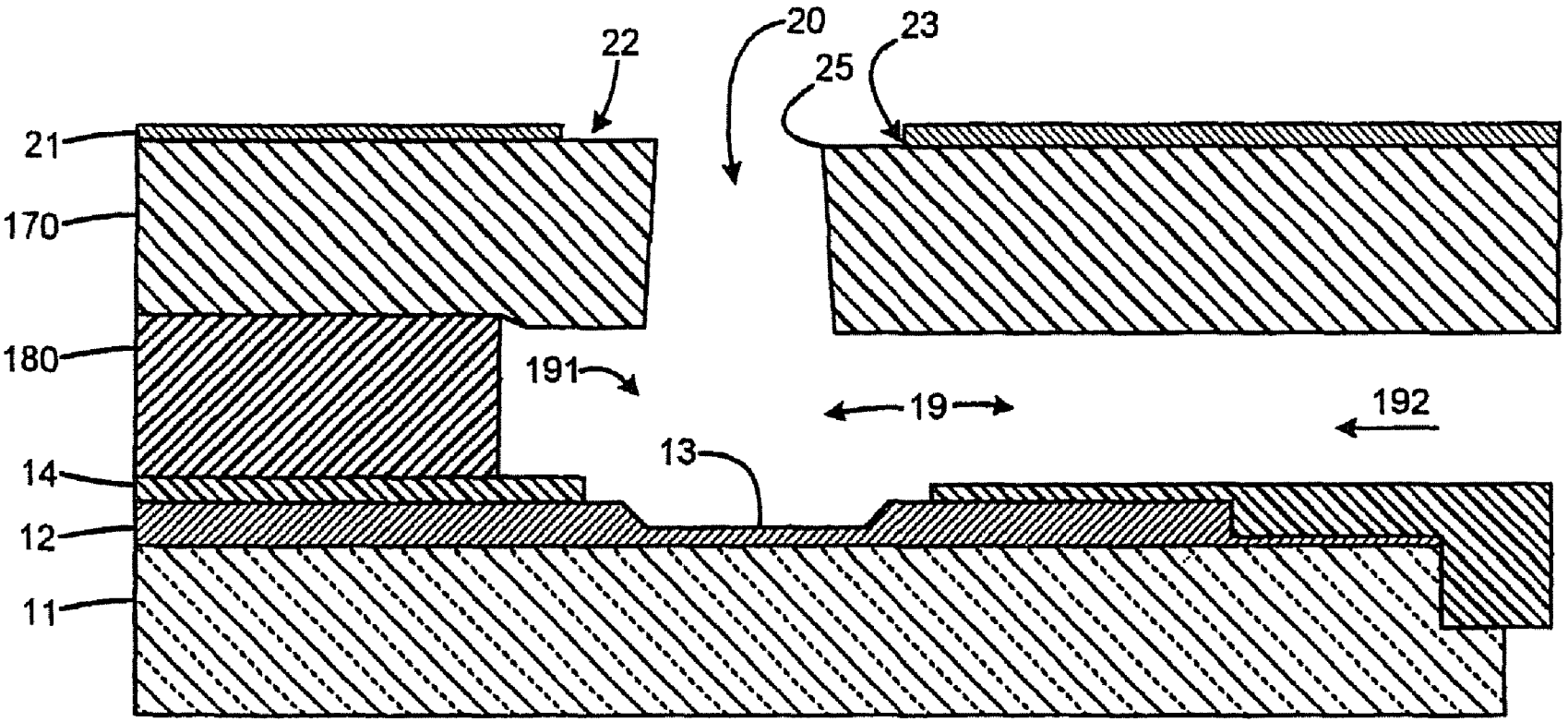
FIG. 8 illustrates an exemplary embodiment of a fluid ejection device manufactured in accordance with an exemplary embodiment of the method illustrated in FIG. 7.

FIG. 8 illustrates an exemplary embodiment of a fluid ejection device 100 manufactured by an exemplary embodiment of the process illustrated in FIG. 7. A thin film stack 12 comprising fluid ejection device circuitry, including resistors 13, is formed on a substrate 11. A primer layer 14 is provided over the thin film stack 12 and the substrate 11. A barrier layer 180 is provided over the primer layer 14. The barrier layer 180 has voids 19 comprising a fluid chamber 191 and a fluid channel 192. An orifice layer 170 is provided over the barrier layer 180. FIG. 8 shows the orifice layer 170 and the barrier layer 180 as being formed from two separate layers. In an exemplary embodiment, however, the two layers can be formed from a single dry-film 16 (FIGS. 2A and 2B) which was laminated over void-shaped filler by an exemplary embodiment of a process illustrated in FIG. 1.

An orifice 20 is formed in the orifice layer 170 over a fluid chamber 191. A counterbore 22 has been formed in a top-coat layer 21 over the orifice layer 170. In an exemplary embodiment, the counterbore 22 provides a barrier to fluid puddling and provides protection to the edges of the orifice exit 25 from damage which may be caused by wiping the surface of the top-coat layer.

In an exemplary embodiment, there is a surface energy discontinuity 23 between the surface of the orifice layer within the counterbore and the edge of the counterbore. In an exemplary embodiment, the top-coat layer 21 and the orifice layer 170 comprise materials of different surface energy. In an exemplary embodiment, the top-coat layer 21 comprises fluoro-epoxide or other fluorinated oligimer. In an exemplary embodiment, the top-coat layer 21 comprises a material that is non-wetting with respect to the fluid to be ejected through the orifices or is less-wetting than the orifice layer is with respect to the fluid to be ejected through the orifices. For example, where the fluid comprises water, the top-coat layer 21 may comprise a hydrophobic material. In an exemplary embodiment, the top-coat layer 21 has a low surface energy and/or a lower surface energy than the orifice layer. In an exemplary embodiment, fluid can wet the surface of the orifice layer in the counterbore up to the top-coat layer. Due to the surface energy discontinuity 23 or the difference in the wetting properties of the top-coat layer 21 and the orifice layer 170, the fluid is prevented from wetting onto the surface of the top-coat layer 21. In an exemplary embodiment, the counterbore mechanically and chemically prevents fluid from wicking onto the surface of the top-coat layer 21.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of manufacturing a fluid ejection device, comprising:

providing a barrier layer and an orifice layer on a substrate;

laminating a layer of photo-resist over a substantially planar surface of the orifice layer;

forming an orifice in the orifice layer; and forming a counterbore in the layer of photo-resist, including exposing a portion of the substantially planar surface of the orifice layer within the counterbore.

2. The method of claim 1, wherein providing the barrier layer and the orifice layer comprises laminating a dry film over filler structures.

3. The method of claim 1, wherein providing the barrier layer and the orifice layer comprises laminating the orifice layer over the barrier layer.

4. The method of claim 1, wherein the layer of photo-resist comprises a fluorinated oligimer.

5. The method of claim 1, wherein the layer of photo-resist comprises fluoro-epoxide.

6. The method of claim 1, wherein forming the orifice in the orifice layer comprises photo-defining the orifice in the orifice layer before laminating the layer of photo-resist over the orifice layer.

7. The method of claim 1, wherein forming the orifice in the orifice layer comprises developing the orifices before laminating the layer of photo-resist over the orifice layer.

8. The method of claim 1, wherein forming the counterbore in the layer of photo-resist comprises exposing the layer of photo-resist to radiation and a post-exposure bake, and developing the layer of photo-resist.

9. The method of claim 1, wherein exposing the portion of the substantially planar surface of the orifice layer within the counterbore includes exposing a portion of the substantially planar surface of the orifice layer surrounding the orifice.

10. The method of claim 1, wherein a surface energy discontinuity exists between the substantially planar surface of the orifice layer within the counterbore and an edge of the counterbore.

11. The method of claim 1, the orifice layer having a first side facing the barrier layer and a second side opposite the first side;

wherein laminating the layer of photo-resist includes laminating the layer of photo-resist over the second side of the orifice layer; and wherein forming the orifice in the orifice layer includes defining an orifice exit of the orifice, as a minimum dimension of the orifice, with the second side of the orifice layer.

12. The method of claim 1, wherein forming the orifice in the orifice layer includes defining an orifice exit of the orifice at the substantially planar surface of the orifice layer.

* * * * *